US005617796A

United States Patent [19]

Trenner et al.

[11] Patent Number: 5,617,796

[45] Date of Patent: Apr. 8, 1997

[54] LONGITUDINAL TRANSFER SYSTEM

[75] Inventors: Albrecht Trenner, Langendorf; Erich Grossenbacher, Derendingen, both of Switzerland

[73] Assignee: Montech AG, Switzerland

[21] Appl. No.: 521,830

[22] Filed: Aug. 31, 1995

[30] Foreign Application Priority Data

Sep. 1, 1994 [DE] Germany ..... 44 31 064.1

[51] Int. Cl.[6] ..... E01B 25/22

[52] U.S. Cl. ..... 104/106; 238/14.3; 238/14.4; 238/151; 238/243; 191/44.1; 403/297

[58] Field of Search ..... 104/106, 107, 104/108, 109, 110, 111; 238/14.3, 14.4, 14.5, 14.6, 14.8, 151, 171, 175, 176, 243, 246, 247, 263; 191/44.1; 403/28, 292, 297

[56] References Cited

U.S. PATENT DOCUMENTS

| | | | |
|---|---|---|---|
| 503,101 | 8/1893 | Seaton | 238/14.6 |
| 2,498,568 | 2/1950 | Mosebach | 191/44.1 |
| 2,831,071 | 4/1958 | Taylor | 191/44.1 |
| 2,933,567 | 4/1960 | Mageoch | 104/111 |
| 3,389,661 | 6/1968 | Wainwright | 104/106 |
| 3,528,608 | 9/1970 | Dashew et al. | 238/175 |
| 4,485,967 | 12/1984 | Edwards | 238/243 |
| 4,967,669 | 11/1990 | Kuchta | 104/106 |
| 5,104,040 | 4/1992 | Bormann et al. | 104/110 |

FOREIGN PATENT DOCUMENTS

| | | |
|---|---|---|
| 0139915 | 5/1985 | European Pat. Off. . |
| 0391164 | 10/1990 | European Pat. Off. . |
| 0471889 | 12/1990 | European Pat. Off. . |
| 0612582 | 2/1994 | European Pat. Off. . |
| 2508949 | 1/1983 | France . |
| 2559173 | 8/1985 | France . |
| 2606609 | 7/1977 | Germany . |
| 84567 | 3/1920 | Switzerland . |

*Primary Examiner*—S. Joseph Morano
*Attorney, Agent, or Firm*—Bachman & LaPointe, P.C.

[57] ABSTRACT

The invention concerns a longitudinal transfer system made out of rail sections for guiding transport cars from one processing station to another, two adjacent rail sections being connected with one another mechanically and electrically. A connecting part and section strips are connected with one rail section incapable of sliding and with the other rail section with play but only so tightly that motion of the second rail section is possible, in particular as a result of expansion.

16 Claims, 4 Drawing Sheets

LONGITUDINAL TRANSFER SYSTEM

BACKGROUND OF THE INVENTION

The invention concerns a longitudinal transfer system made out of rail sections for conducting transport cars from one work station to another, two adjacent rail sections being connected with one another mechanically and electrically.

As a result of the ever increasing demands of modern businesses in international competition, quality and quantity, and, in particular, productivity have to be increased in order for businesses to remain competitive. That is, the products have to be produced and assembled more cost-effectively. Correspondingly it is necessary that the production processes be automated and linked together. This linkage of production processes and assembly operations plays an ever increasing role in modern manufacturing.

In this case individual areas and processing stations in the plant are connected with one another and can cooperate with one another via longitudinal transfer systems.

A longitudinal transfer system essentially consists of individual rail tracks, which are assembled and on which workpieces to be processed or tools, in a given case are transported automatically on transport cars from work station to work station. Workpieces are processed at the work stations, then, for example, conveyed from the production area to the quality control area and then to the assembly area.

In order to overcome temporary bottlenecks and to make parallel assembly processes possible, for example, by-pass systems corresponding to EP-A 94102382.2 have been developed for a longitudinal transfer system. The by-pass system makes it possible to carry out parallel processes, which make highly flexible production processes possible.

Up to now it has not been possible to switch a longitudinal transfer system to another line within a short time. Only with considerable expenditure of time is it possible, for example, to integrate a by-pass into a longitudinal transfer system. This results in a breakdown of the entire transfer line and all other working processes are blocked. Therefore, for the most part these operations are performed on the weekend, and consequently they are extremely cost- and time-intensive.

A further significant disadvantage is that a longitudinal expansion (dilation) of the rail track of a longitudinal transfer system takes place as a result of temperature differences in the different, spatially separate production and assembly shops or as a result of seasonal changes. Therefore expansion joints, which of course have to be precisely bridged over, are provided between the individual rail tracks.

In this case also it is to be noted that the electric power of a longitudinal transfer system for corresponding cars, which convey workpieces and tools from one processing station to another, is conducted via the rail itself. Therefore current conductors, which consist of another material, such as the rail itself, are associated with the rails. This results in a different longitudinal expansion, which also has to be taken into account at the connecting points of the individual rail tracks.

SUMMARY OF THE INVENTION

The present invention is based on the task of creating a connection capability in a longitudinal transfer system, which takes account of expansion and makes a rapid replacement of rail sections possible.

The fact that a connecting part or section strip is connected with a rail section so tightly that it cannot slide and has a positive connection with respect to the other one, but only so tightly so that motion of the second rail section is possible, in particular as a result of expansion, leads to the solution of this problem. Further this leads to having a bridge be associated with the two current conductors of two adjacent rail sections so that the bridge loads one current conductor with a higher pressure than the other current conductor.

In accordance with the present invention, rail tracks of a transfer system are connected with one another mechanically and electrically so that expansion joints are bridged over, that on the one hand the current conductors further can be supplied with current and on the other hand that the rail itself has a smooth transition to the next rail section. At the same time, in addition to the mechanical and electric connection, it is insured that an expansion of the electric conductors and of the rail section is always possible in spite of a mechanically precise connection.

A further essential advantage of the present invention is that both the mechanical and the electric connections can be broken very quickly so that a rail track can be changed very rapidly, and that, for example, a by-pass also can be inserted rapidly from the side without considerable assembly expense.

One part of the mechanical connection is made via a connecting part which is inserted into a groove in the rail sections so that it is clamped in the groove in one rail section of this connecting part by means of two setscrews which push apart a slot via a ball. In the adjacent rail section, the fastening part is mounted so that longitudinal displacement due to expansion still is possible, but the rail tracks align with each other exactly and are aligned with respect to each other so that a car which moves over the travelling surface of the rail sections is not at all negatively influenced by the transition.

Further the mechanical connection is made via two section strips which are connected by threaded bolts and engage into wedge grooves. These threaded bolts pull the two section strips together to the left and right of a joint between two rail sections. However, in addition to a threaded bolt on one side of the joint there is also a setscrew which pushes the section strips apart again so that a rail section is held between the section strips without play but capable of sliding.

The present invention also provides for having a breakable electric connection, corresponding to the mechanical connection, between two rail sections of a transfer system.

In the present specific embodiment, an insulating shoe, which preferably consists of current-insulating material, is inserted into a window between two rail section ends. A clamping piece, which has two threaded holes and a shaft, is pushed into the insulating shoe. A bridge, which presses on current conductors, which are held by the clamping piece over the bridge, is inserted into the shaft. Preferably the bridge is made out of two contact surfaces on both sides of a recess, so that in each case each one of the two contact surfaces lies on a current conducting lug. In this case, there is a gap between the current conductor lugs which also serves as an expansion joint for the current conductor. The bridge is tightened eccentrically against the current conductors by means of a clamping piece so that one contact surface is clamped tight on one side but the other current conductor is capable of moving on the other side.

The bridge is made out of a current-conducting material, preferably out of material containing copper, so that an optimal transfer of the current is provided. The setscrew which pushes the bridge against the current conductor is engaged with a screwdriver through an opposite window. The window is closed by means of a cover.

Within the framework of the invention of course it is possible that several current conductors can be insulated in several grooves integrated in the rail section and/or the current conductors also can be arranged on both sides of the rail sections. Further, it is within the framework of the invention that the mechanical and also the electric connection can be used alone, but the combination of the two is preferred.

BRIEF DESCRIPTION OF THE DRAWINGS

Further advantages, features, and details of the invention result from the following description of preferred specific embodiments as well as by means of the drawings, wherein.

DETAILED DESCRIPTION OF THE PREFERRED EMBODIMENTS

Figure 1:
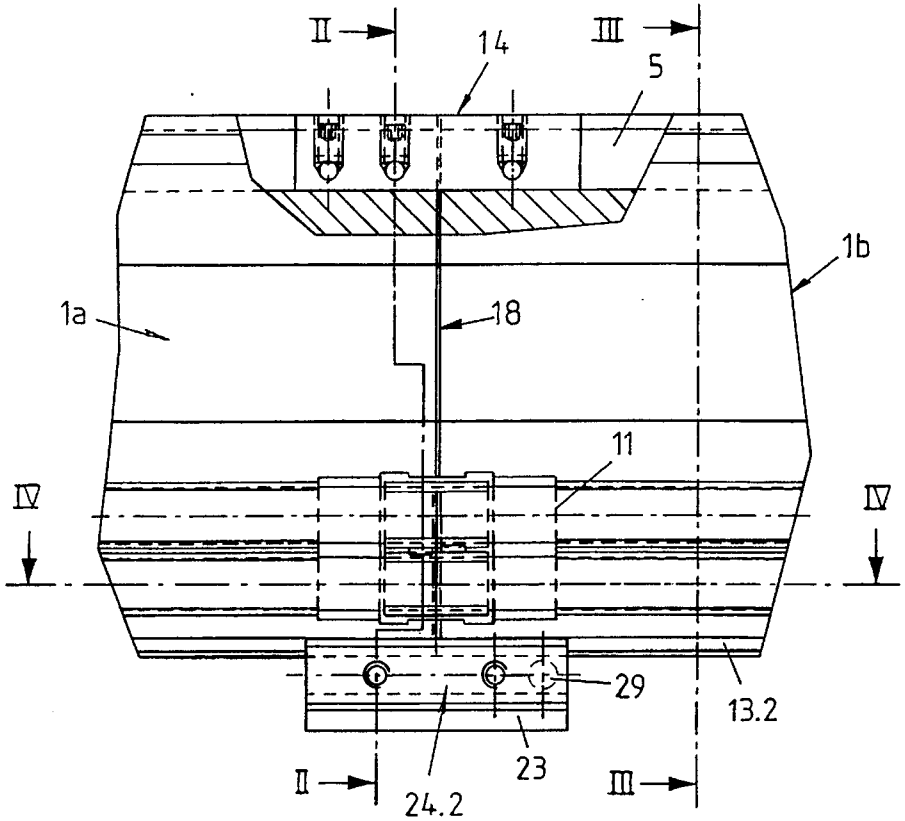
FIG. 1 shows a side view of a section of a longitudinal transfer system in accordance with the invention shown partially broken.

Two rail sections 1*a*, 1*b* of a longitudinal transfer system, which are butted together, are shown in FIG. 1. The sections 1*a*, 1*b* are connected with one another via a mechanical and an electric connection.

Figure 3:
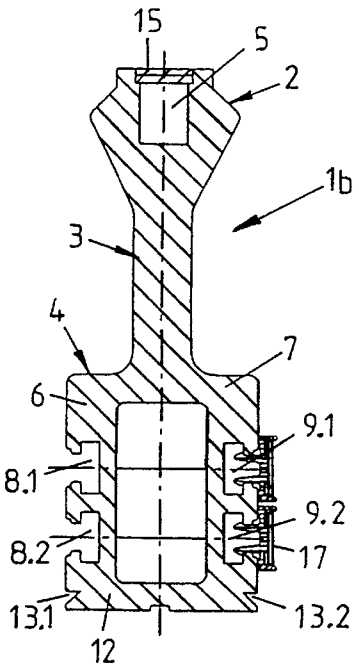
FIG. 3 shows a cross-section through the longitudinal transfer system along line III—III in FIG. 1.

As shown in FIG. 3, each rail section 1*a*, 1*b* has a head 2 with running surfaces for a transport car not shown in greater detail, with which a rectangular hollow section 4 is connected via a neck 3. A longitudinal groove 5 is molded in the head 2.

Figure 2:
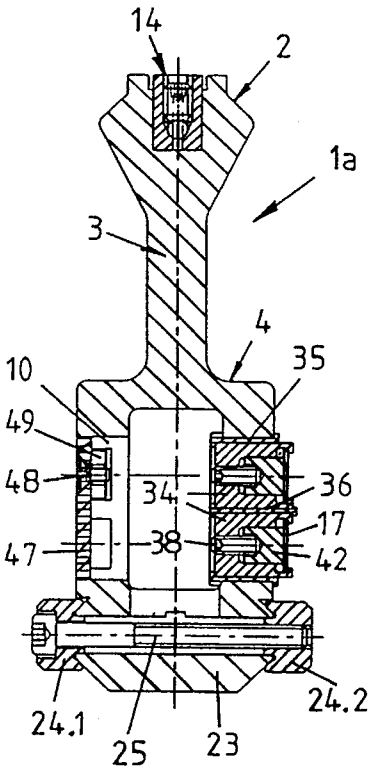
FIG. 2 shows a cross-section through the longitudinal transfer system along line II—II in FIG. 1.

In each case, two T-grooves 8.1, 8.2, and 9.1, 9.2, respectively, lying opposite each other are molded into a left and a right side wall 6 and 7, respectively, of the hollow section 4, in the area of which grooves or windows are cut in the side walls 6 and 7 at the end of a rail section 1*a*, 1*b*, as is shown, in particular, in FIG. 2. Thus, the combination of two rail sections 1*a*and 1*b* results in a left window 10 and a right window 11.

In addition to a connecting point between two rail sections 1*a* and 1*b*, the groove 5 is covered by a cover strip 15. Snap connections 16, which hold current conductors 17, are clamped into the T-grooves on the right side.

A downward-pointing surface of the hollow section 4 is made as a swallowtail 12, a keyway 13.1 and 13.2, in each case being molded into the two side walls 6 and 7.

A joint 18 between the two rail sections 1*a* and 1*b* is bridged over by a mechanical connection and an electric connection in the area of a connection point. The mechanical connection has a connecting part 14, which is inserted into the groove 5 of both rail sections, overlapping the joint 18.

Figure 5:
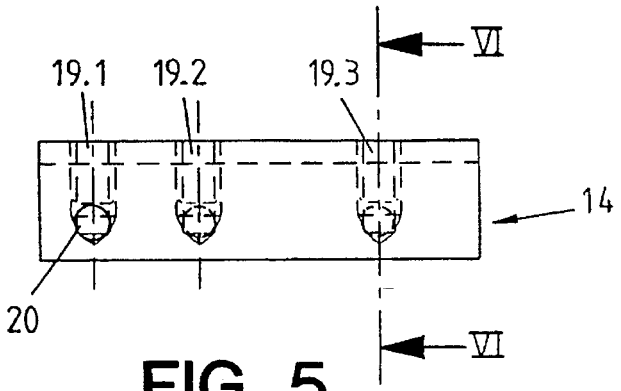
FIG. 5 shows a top view of a connecting part in accordance with the invention shown enlarged.
Figure 6:
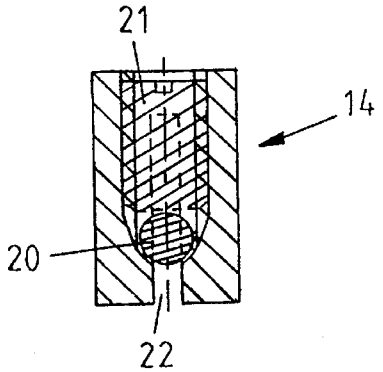
FIG. 6 shows a cross-section through the connecting part along line VI—VI in FIG. 5, shown enlarged.

The essential feature of the connection part 14 is that in accordance with FIG. 5, three blind holes 19.1, 19.2 and 19.3 are provided, a ball 20 being inserted into each blind hole, which ball by means of a setscrew 21 pushes apart a slot 22 in the bottom of the connection part 14 by means of tightening the setscrew 21.

The basic idea here is that two blind holes 21 are provided on one half of the connecting part 14 and only one blind hole 21 is provided on the other half.

After the connecting part 14 is inserted into the groove 5, the two blind holes 19.1 and 19.2, the two setscrews 21 of which are tightened, are located on one side in the rail section 1*a*. In this way, the connecting part 14 is tightly connected with the section 1*a*. The rail section 1*b* pushed out upon impact is tightened on the other side of the connecting part 14 only with one setscrew 21 so far that a connection is made between the sections 1*a* and 1*b* which is a positive connection but not clamping, and thus motion in the longitudinal direction is possible, if the joint 18 is made larger or smaller by means of expansion.

A further part of the mechanical connection assumes the fastening of the rail sections 1*a* and 1*b* on a connecting plate 23, which, for example, can be part of a carrier frame. A left and a right section strip or profile section 24.1 and 24.2, which are described in greater detail in EP-A 90124167.9 and which work together with threaded bolt 25, are provided for the connection.

Figure 9:
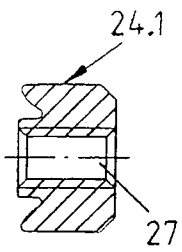
FIG. 9 shows a cross-section through the left section strip along line IX—IX in FIG. 7.
Figure 8:
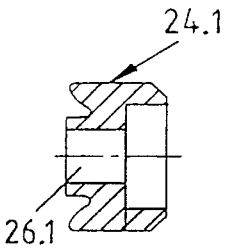
FIG. 8 shows a cross-section through the left section strip along line VIII—VIII in FIG. 7.
Figure 7:
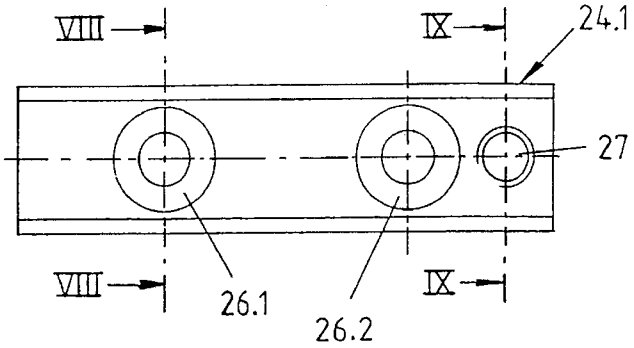
FIG. 7 shows a top view of a left section strip in FIG. 2, shown enlarged.
Figure 12:
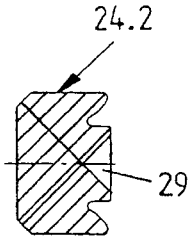
FIG. 12 shows a cross-section through the right section strip along line XII—XII in FIG. 10.
Figure 11:
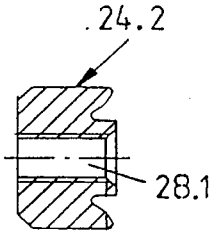
FIG. 11 shows a cross-section through the right section strip along line IX—IX in FIG. 10.
Figure 10:
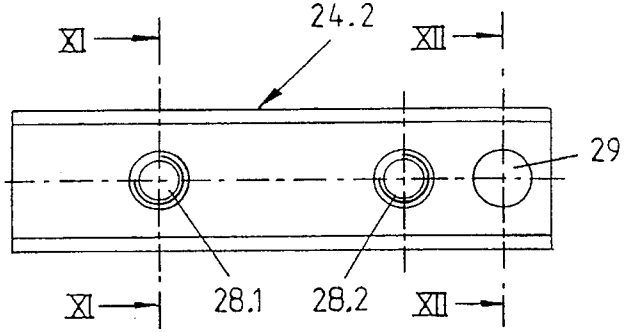
FIG. 10 shows a top view of a right section strip in FIG. 2.

In this case, the left section strip 24.1 in accordance with FIGS. 7–9 has two graduated holes 26.1 and 26.2 and a threaded hole 27. In accordance with FIGS. 10–12, the right section strip 24.2 has threaded holes 28.1 and 28.2 into which the threaded bolt 25 can engage, correspondingly symmetrical to the graduated holes 26.1 and 26.2. On the other hand, a setscrew not shown here, which is provided with a conical point on one side, is inserted into the threaded hole 27 of the section strip 24.1. This conical point engages into a conical groove 29 (FIG. 12) and thus acts upon the section strips 24.1, 24.2 with a spreading pressure.

In this case the setscrew and the conical groove 29 are arranged on each side of the joint 18, which also is held loosely and with a positive connection by means of the connecting part 14, so that the very long rail sections 1*a*, 1*b* can expand along their longitudinal axes with a corresponding expansion in the case of temperature fluctuations.

Precise adjustment and loosening of the connection of the rail sections 1*a* and 1*b* are possible by means of the chosen mechanical connection.

Figure 13:
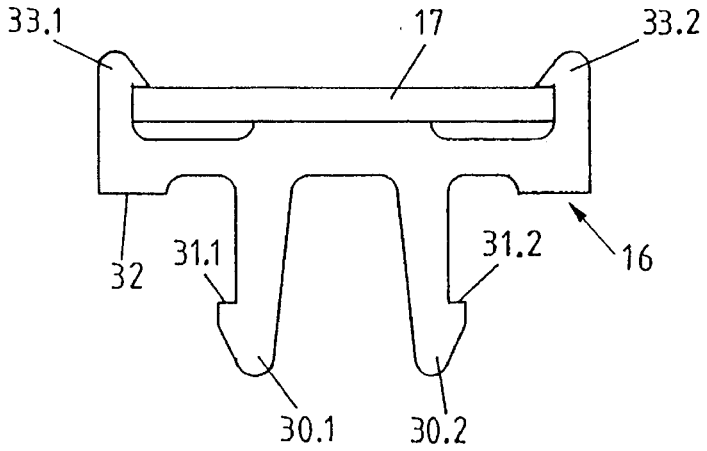
FIG. 13 shows a top view of a snap connection in accordance with the invention with inserted current conductor.
Figure 14:
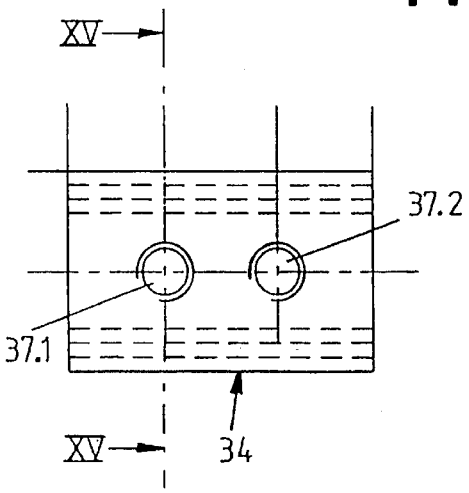
FIG. 14 shows a front view of a clamping piece in accordance with the invention.

In addition to the mechanical, releasable play-free connection, an electric connection also has to be insured in order to provide the longitudinal transfer system with current, and in order to drive and control transport cars. The current is supplied via current conductors 17 in the snap connections 16 as shown in FIG. 13.

Detents 30.1 and 30.2 are provided via which the snap connection 16 are clipped into the T-grooves 9.1 and 9.2, the detents being gripped with stops 31.1 and 31.2. In this case, each snap connection 16, preferably made out of insulating material, lies on the outer surface of the rail section 1*a*, 1*b* with bearing surfaces 32.

The current conductor 17 is clipped between two further detents 33.1 and 33.2, the current conductor 17 preferably consisting of copper. The snap connections 16 are clipped into the T-grooves 9.1 and 9.2 1 laterally along the rail sections 1*a*, 1*b* between two windows 11 and insulate the current conductor 17 from the sections 1*a*, 1*b*. Of course, the current conductors 17 project from both sides with lugs into the open space of the window 11 and push against one another, or also form a joint. The latter is bridged over by the electric connection.

An insulating shoe 35, which has clamping pieces 34, is inserted into the window 11 for this. The insulating shoe 35 preferably is made out of non-conducting material, such as, for example, plastic, and is clipped into the window 11, the insulating shoe 35 being separated by a cross-piece 36.

The clamping piece 34 is provided with two threaded holes 37.1 and 37.2, the setscrew 38 (see FIG. 4) engaging into one of the two. The other hole is provided for an electrical connection not shown here. In this case, the current conductor 17 can be supplied with current at each connecting point via this hole.

Figure 15:
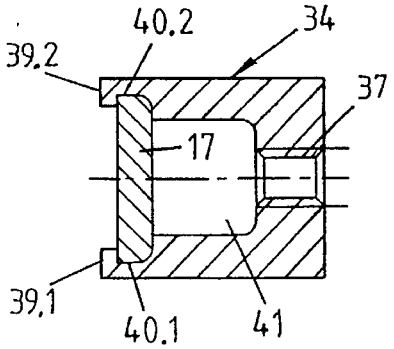
FIG. 15 shows a cross-section through the clamping piece along line XV—XV in FIG. 14 with inserted current conductor.
Figure 16:
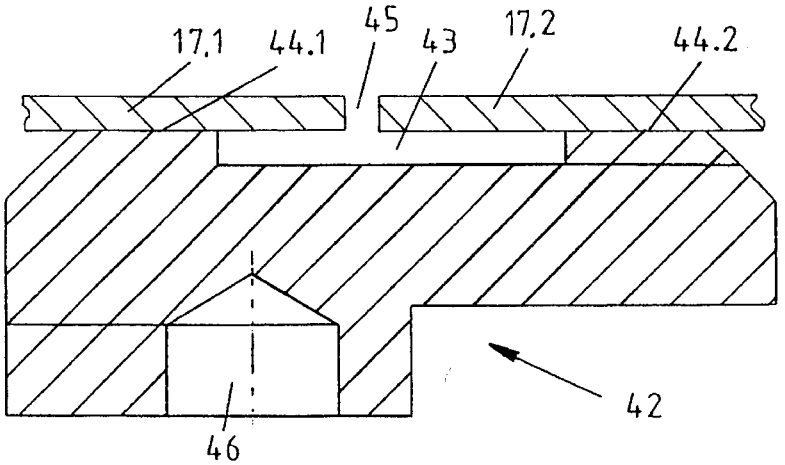
FIG. 16 shows a magnified cross-section through a bridge in accordance with the invention with eccentric position.

As shown in FIG. 15, the clamping piece 34 is made so that the current conductor is clipped into grooves 40.1 and 40.2 between two clamping strips 39.1 and 39.2. Directly behind the current conductor 17 there is a shaft 41, into which a bridge 42 is inserted. On the one side turned toward the current conductors 17.1 and 17.2, the bridge 42 is provided with a recess 43, which separates two contact surfaces 44.1 and 44.2 from one another. By means of the contact surfaces 44.1 and 44.2, the bridge 42 bridges over a gap 45 between the two current conductors 17.1 and 17.2.

On the opposite side of the contact surfaces 44.1 and 44.2, the bridge 42 has an eccentrically located guide hole 46, into which the setscrew 38 engages in order to exert pressure upon the bridge 42.

The bridge 42 is inserted into the insulating shoe 35 together with the clamping piece 34. On the side of the rail section 1*a*, the contact surface 44.1 is pressed eccentrically against the current conductor 17.1 by screwing in the setscrew 38.

Only a slight pressure acts on the current conductor 17.2 of the rail section 1*b* through the contact surface 44.2. In this case, there is tight clamping only to the degree that the current conductor 17.2 can move along the contact surface 44.2 in the case of expansion as a result of a temperature difference. Therefore, the gap 45 is provided between the current conductor 17.1 and the current conductor 17.2 in order to be able to equalize longitudinal expansion as a result of temperature differences. This gap 45 is bridged over electrically by the bridge 42 and thus the current is conducted from the current conductor 17.1 via the bridge 42 to the current conductor 17.2

Figure 4:
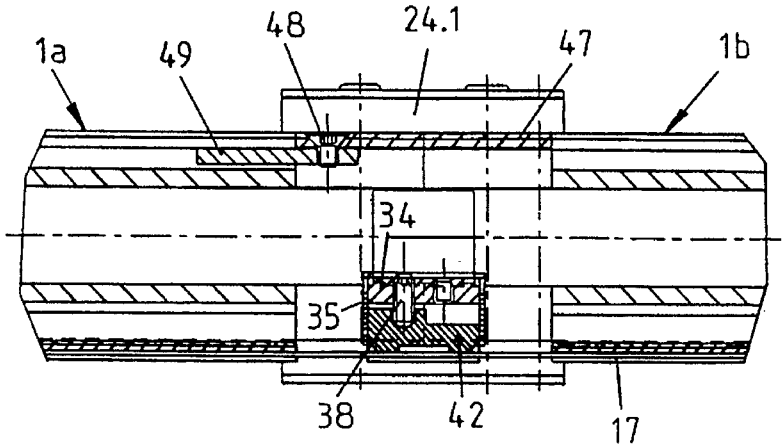
FIG. 4 shows a longitudinal section through the longitudinal transfer system along line IV—IV in FIG. 1.

In order to be able to make access to the setscrew 38 possible, in FIGS. 2 and 4 it can be seen that the window 10 is closed with a closing cover 47, which is fastened by means of a fastening element 48, which engages into a holding strip 49. In this case, the holding strip 49 is pushed into one of the two T-grooves 8.1, 8.2, so that the closing cover 47 disappears in the rail section and the outer surface of the section is not influenced by it.

What is claimed is:

1. A longitudinal transfer system, which comprises rail section having longitudinal axes for guiding transport cars from one processing station to another, with two adjacent rail sections separated by a joint therebetween being connected with one another mechanically, wherein for the mechanical connection one connecting part and profile section are rigidly connected with one of said rail sections so that said one rail section cannot slide, and with a positive connection to another adjacent second of said rail sections but only so tightly that motion of the second rail section in the longitudinal direction is possible, wherein said connecting part and profile section overlap said joint, with said connecting part inserted into a longitudinal groove in said rail sections, and wherein the rail sections can expand along their longitudinal axes in case of temperature fluctuation and to permit precise adjustment of the rail sections.

2. A longitudinal transfer system according to claim 1 wherein motion of the second rail section as a result of expansion is possible.

3. A longitudinal transfer system according to claim 1 wherein a bridge is associated with two current conductors of said two adjacent rail sections so that the bridge acts with a higher pressure on one current conductor than on the other current conductor.

4. A longitudinal transfer system in accordance with claim 3, wherein said rail sections are provided with keyways into which section strips engage and connect the rail sections with a connecting plate means.

5. A longitudinal transfer system according to claim 1, with two adjacent rail sections being connected with one another mechanically and electrically.

6. A longitudinal transfer system which comprises rail sections for guiding transport cars from one processing station to another, with two adjacent rail sections being connected with one another mechanically and electrically, wherein a bridge is associated with two current conductors of said two adjacent rail sections so that the bridge acts with a higher pressure on one current conductor than on the other current conductor, wherein the bridge has at least one contact surface on both sides of a recess, a higher pressure acting upon said one contact surface through an eccentrically located setscrew on one clamping piece.

7. A longitudinal transfer system in accordance with claim 6, wherein a hole for the supply of current to the bridge and the current conductors is provided in the clamping piece.

8. A longitudinal transfer system in accordance with claim 6, wherein the clamping piece has a shaft in which the bridge is located.

9. A longitudinal transfer system in accordance with claim 8 wherein the current conductors are held in grooves by clamping bars via the shaft, and the clamping piece.

10. A longitudinal transfer system in accordance with claim 6, wherein the clamping piece rests in an insulating shoe, which is inserted into a window between said two rail sections.

11. A longitudinal transfer system in accordance with claim 6, wherein the setscrew is accessible through a window in one of said rail sections, it being possible to close the window with a closing cover.

12. A longitudinal transfer system in accordance with claim 6, wherein a connecting part is inserted into a longitudinal groove in said rail sections, which connecting part has a slot and is provided with at least one blind hole, into which a ball is inserted, said ball pushing apart the slot by means of tightening a screw.

13. A longitudinal transfer system in accordance with claim 12, wherein the connecting part on one side of a joint between two rail sections has two blind holes and on the other side has one blind hole, less pressure acting upon the ball on the side with one blind hole.

14. A longitudinal transfer system which comprises rail sections for guiding transport cars from one processing station to another, with two adjacent rail section being connected with one another mechanically and electrically, wherein a bridge is associated with two current conductors of said two adjacent rail section so that the bridge acts with a higher pressure on one current conductor than on the other current conductor, wherein said rail sections are provided with keyways into which section strips engage and connect the rail sections with a connecting plate means, and wherein one section strip has two graduated holes and a threaded hole adjacent one graduated hole.

15. A longitudinal transfer system in accordance with claim 14, wherein the other section strip has two separate threaded holes and a conical groove adjacent one of said separate threaded hole.

16. A longitudinal transfer system in accordance with claim 15, wherein the section strips are acted upon by tension through at least one threaded bolt and by pressure via at least one setscrew passing through the threaded hole of said one section strip and supported against said conical groove of the other section strip.

* * * * *